US010870967B2

(12) United States Patent
Colwell et al.

(10) Patent No.: US 10,870,967 B2
(45) Date of Patent: Dec. 22, 2020

(54) MEDIUM VOLTAGE ROOM FOR A MINING SHOVEL

(71) Applicant: Joy Global Surface Mining Inc, Milwaukee, WI (US)

(72) Inventors: Joseph Colwell, Hubertus, WI (US); Joshua Vizanko, Saukville, WI (US); Donald Daniel, East Troy, WI (US); Owen Warr, Muskego, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 16/388,950

(22) Filed: Apr. 19, 2019

(65) Prior Publication Data

US 2019/0323206 A1 Oct. 24, 2019

Related U.S. Application Data

(60) Provisional application No. 62/660,660, filed on Apr. 20, 2018.

(51) Int. Cl.
*E02F 9/16* (2006.01)
*E02F 9/20* (2006.01)

(52) U.S. Cl.
CPC ..... *E02F 9/163* (2013.01); *E02F 9/2058* (2013.01)

(58) Field of Classification Search
CPC ..... E02F 9/163; E02F 9/2058
See application file for complete search history.

(56) References Cited

U.S. PATENT DOCUMENTS 7,227,273 B2 * 6/2007 Ahmad ..... B60L 50/51 290/40 C
7,307,399 B2 * 12/2007 Furem ..... E02F 9/2025 318/372
7,375,490 B2 * 5/2008 Furem ..... H02M 1/12 318/375
7,609,024 B2 * 10/2009 Ahmad ..... B60L 50/51 318/811
7,622,884 B2 * 11/2009 Furem ..... B66C 13/22 318/375
8,378,608 B2 * 2/2013 Robertson ..... H02M 5/4505 318/438
8,515,708 B2 * 8/2013 McAree ..... E02F 3/435 702/150
8,935,866 B2 * 1/2015 Bienfang ..... E02F 3/425 37/445

(Continued)

OTHER PUBLICATIONS

CAT, "7495 Electric Rope Shovel," 2016, 32 pages.

(Continued)

*Primary Examiner* — Robert J Hoffberg
(74) *Attorney, Agent, or Firm* — Michael Best & Friedrich LLP

(57) ABSTRACT

A mobile mining machine includes a base with a deck and a counterweight box, a hoist drum supported on the deck, a motor drivably coupled to the hoist drum, a main transformer configured to supply power to the motor, an auxiliary transformer, and an electrical room coupled to the base. The main transformer and the auxiliary transformer are positioned inside the electrical room, and the electrical room contains at least one unguarded electrical connection.

20 Claims, 7 Drawing Sheets

(56) References Cited

U.S. PATENT DOCUMENTS

| | | | | |
|---|---|---|---|---|
| 8,959,805 | B2 * | 2/2015 | Bienfang | E02F 9/2271 37/445 |
| 9,016,419 | B2 * | 4/2015 | Nishimura | E02F 9/0833 180/89.13 |
| 9,127,435 | B2 * | 9/2015 | Bienfang | E02F 9/18 |
| 9,511,780 | B2 * | 12/2016 | Tai | B61C 17/04 |
| 9,702,114 | B2 * | 7/2017 | Larson | E02F 9/18 |
| 9,702,250 | B2 * | 7/2017 | Szpek, Jr. | E02F 9/18 |
| 2018/0318743 | A1 * | 11/2018 | Colwell | B01D 46/44 |

OTHER PUBLICATIONS

Joy Global, "2300XPC Electric Mining Shovel—DC Drive Product Overview," 2012, 8 pages.

P&H, "4100XPC Electric Mining Shovel Digital AC Drive Control," 2011, 4 pages.

* cited by examiner

MEDIUM VOLTAGE ROOM FOR A MINING SHOVEL

CROSS-REFERENCE TO RELATED APPLICATIONS

This application claims priority to U.S. Provisional Patent Application No. 62/660,660 filed Apr. 20, 2018, the entire content of which is incorporated herein by reference.

BACKGROUND

The present disclosure relates mining shovels, and specifically to housing configurations for electrical components of mining shovels.

Existing electric mining shovels may have a main drive transformer configured to convert a high voltage input to a relatively lower voltage output to be supplied to the main motion drives of the shovel. Electric mining shovels may also have an auxiliary transformer that is used to convert a high voltage input to a relatively lower output voltage for use on multiple secondary applications.

The main drive transformer and the auxiliary transformer are typically positioned on the deck of the shovel in vented cabinets. Other electrical components, such as loadbreak switches (e.g., VERSARUPTER switches) for the main and auxiliary transformers, vacuum contactors for the main transformer, current transformers, potential transformers, fuses, lightning arrestors, power monitoring hardware, arc flash sensors, and anti-condensation heaters, are typically housed in a separate medium voltage ("MV") switchgear cabinet.

The transformers and the components in the MV switchgear cabinet are all independently wired together in the field when the mining shovel is erected. This requires time, expense, and additional logistical planning. In addition, because service clearance is required around both transformers and the MV switchgear cabinet, a significant amount of deck space is required. Furthermore, if one of these components fails in service, the entire unit is typically replaced, which requires substantial disassembly to gain access to the particular component. Finally, the electrical components in the MV switchgear cabinet, the main transformer, and the auxiliary transformer each require anti-condensation heaters and cooling means, resulting in duplication of components.

SUMMARY

The disclosure provides, in one aspect, a mobile mining machine including a base with a deck and a counterweight box, a hoist drum supported on the deck, a motor drivably coupled to the hoist drum, a main transformer configured to supply power to the motor, an auxiliary transformer, and an electrical room coupled to the base. The main transformer and the auxiliary transformer are enclosed within the electrical room.

The disclosure provides, in another aspect, a mobile mining machine including a base with a deck and a counterweight box, a main housing coupled to the deck, an electrical room including a plurality of walls and a roof, a transformer positioned inside the electrical room, and a loadbreak switch associated with the transformer and positioned inside the electrical room.

The disclosure provides, in another aspect, an electrical room for a mobile mining machine. The electrical room includes a plurality of side walls, a roof interconnected with the plurality of side walls, a main transformer disposed within the electrical room and configured to supply power to a first plurality of external loads, an auxiliary transformer disposed within the electrical room and configured to supply power to a second plurality of external loads, and a plurality of loadbreak switches disposed within the electrical room. The electrical room contains a plurality of unguarded electrical connections.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
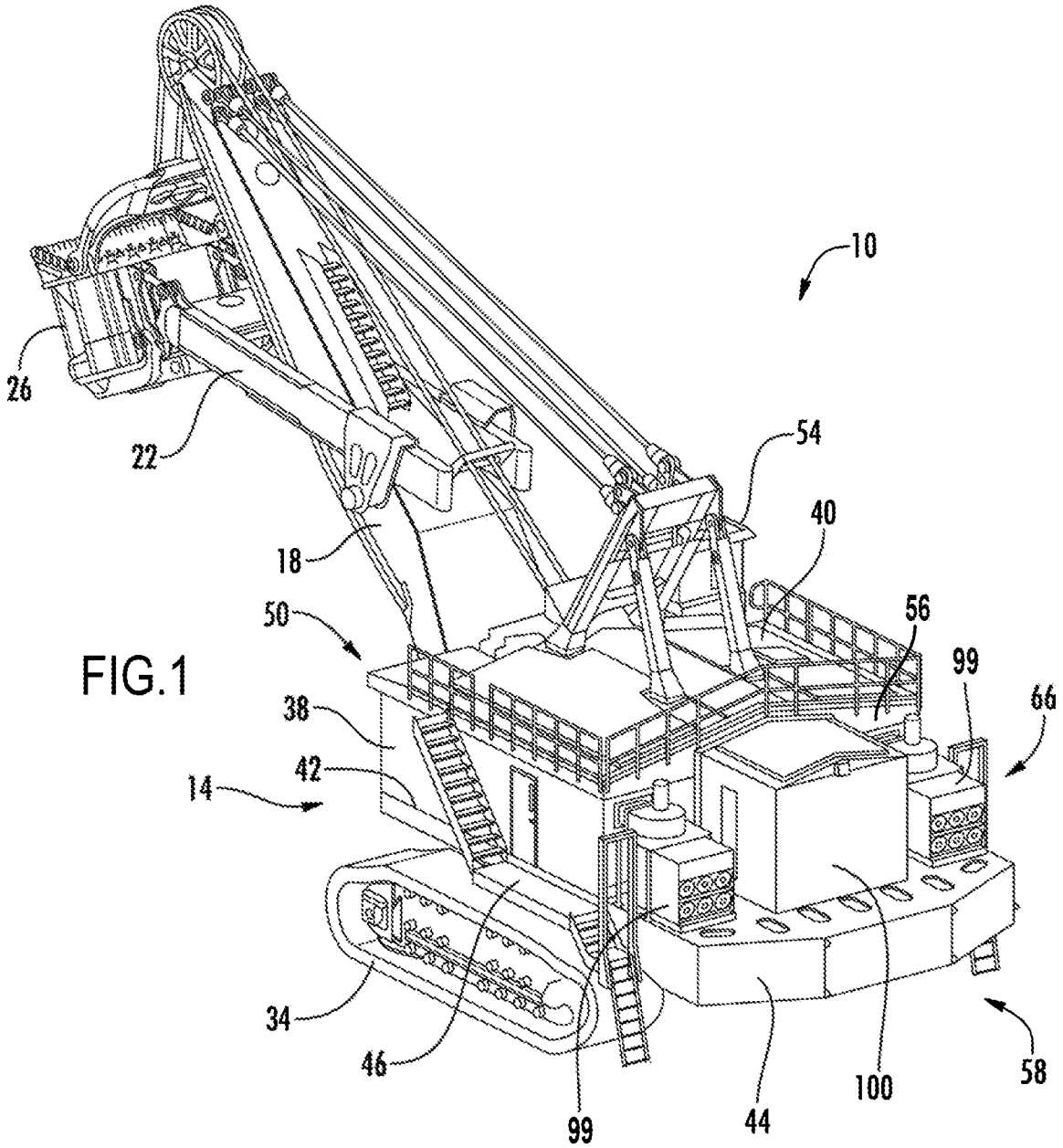
FIG. 1 is a perspective view of an electric mining shovel including a medium voltage room according to an embodiment of the disclosure.

With reference to FIG. 1, an electric mining shovel 10 includes a base 14, a boom 18, a first member or handle 22, and a bucket 26. The boom 18 is coupled to the base 14, the handle 22 is coupled to the boom 18, and the bucket 26 is coupled to the handle 22. In the illustrated embodiment, the base 14 is supported on a chassis with crawler tracks 34. In addition, the base 14 is rotatable with respect to the chassis and crawler tracks 34. The mining shovel 10 further includes a main housing 38 coupled to the base 14. Specifically, the base 14 includes a deck 42 upon which the main housing 38 is positioned. The illustrated deck 42 includes a counterweight box 44 configured to receive counterweight material to balance the mining shovel 10 and walkways 46 to facilitate moving about the deck 42.

With continued reference to FIG. 1, the boom 18, the handle 22, and the bucket 26 are coupled to the base 14 such that the boom 18, handle 22, and bucket 26 project beyond a first or front end 50 of the base 14. An operator's station or cab 54 is positioned proximate the front end 50 of the base 14 and, in the illustrated embodiment, projects slightly beyond the front end 50 to improve operator visibility. The counterweight box 44 defines a second or rear end 58 of the base 14 opposite the front end 50.

Figure 2:
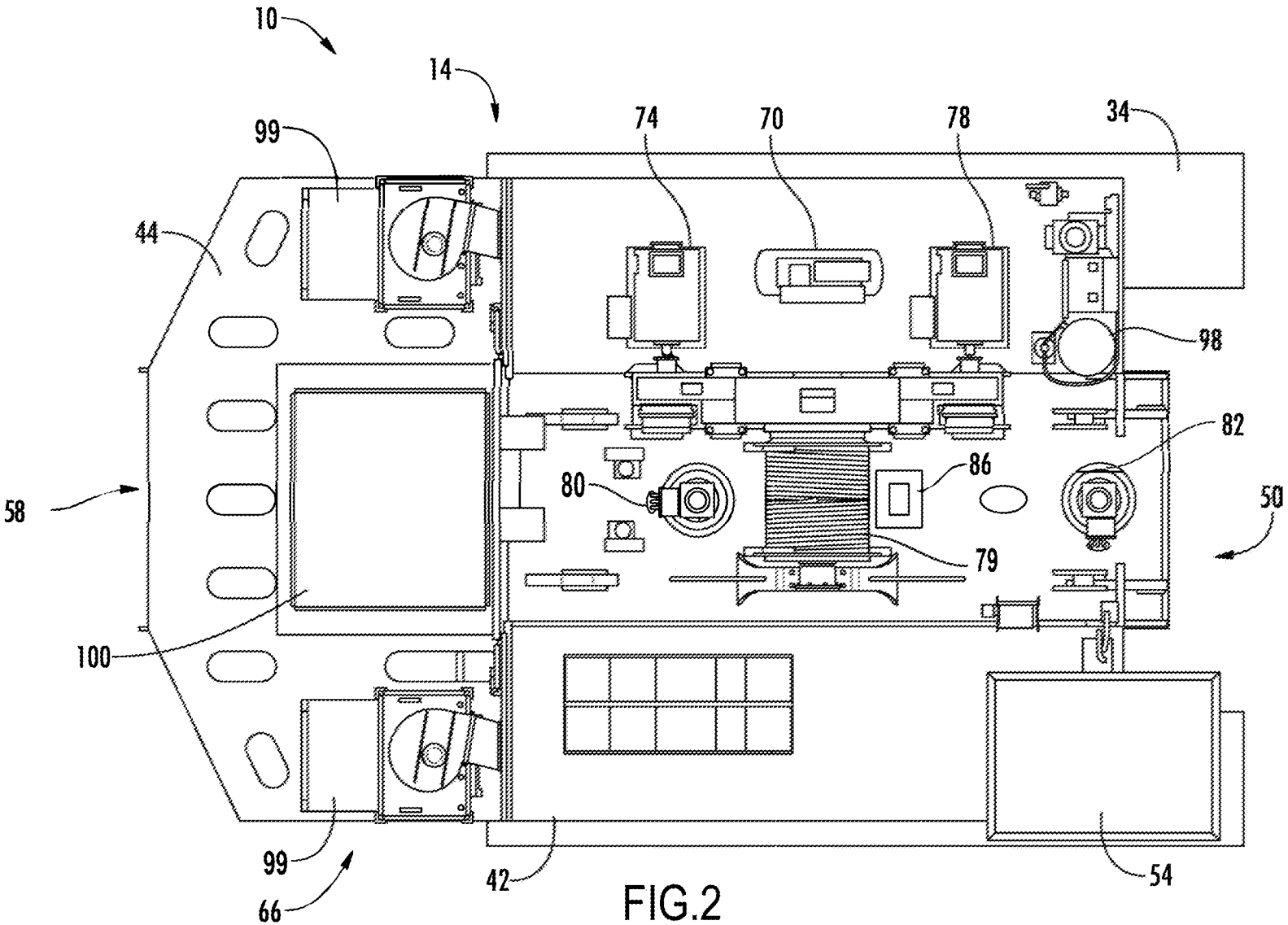
FIG. 2 is a top view of a deck of the mining shovel of FIG. 1.

With reference to FIG. 2, the deck 42 supports (and the main housing 38 at least partially encloses), among other things, an air filtration assembly 66, an air compressor 70, a first hoist motor 74, a second hoist motor 78, a hoist drum 79, a first swing motor 80, a second swing motor 82, a collector 86, and a lubricant tank 98. The hoist drum 79 is rotatably driven by one or both of the first and second hoist motors 74, 78 (e.g., via a transmission). The first swing motor 80, the second swing motor 82, or both may be operable to swivel the base 14 relative to the chassis. The chassis supports propel motors (not shown) for driving the crawler tracks 34.

With reference to FIG. 1, the air filtration assembly 66 provides filtered air into the main housing 38 for cooling purposes and may also be used to maintain positive pressure within the main housing 38. The illustrated air filtration assembly 66 includes two air filtration units 99 that are coupled to the deck 42 and positioned on the counterweight box 44. The air filtration units 99 are disposed on opposite lateral sides of an electrical room 100, which may contain one or more transformers or other electrical components of the mining shovel 10. In alternative embodiments, the air filtration assembly 66 may include one, two, or greater than two air filtration units 99.

In the illustrated embodiment, the electrical room or medium voltage ("MV") room 100 is located on the counterweight box 44, adjacent a rear wall 56 of the main housing 38. In some embodiments, the MV room 100 is welded to the counterweight box 44. Alternatively, the MV room 100 may be bolted to the counterweight box 44, or fastened to the counterweight box 44 in a variety of other ways. In other embodiments, the MV room 100 may be positioned elsewhere on the deck 42.

Figure 4:
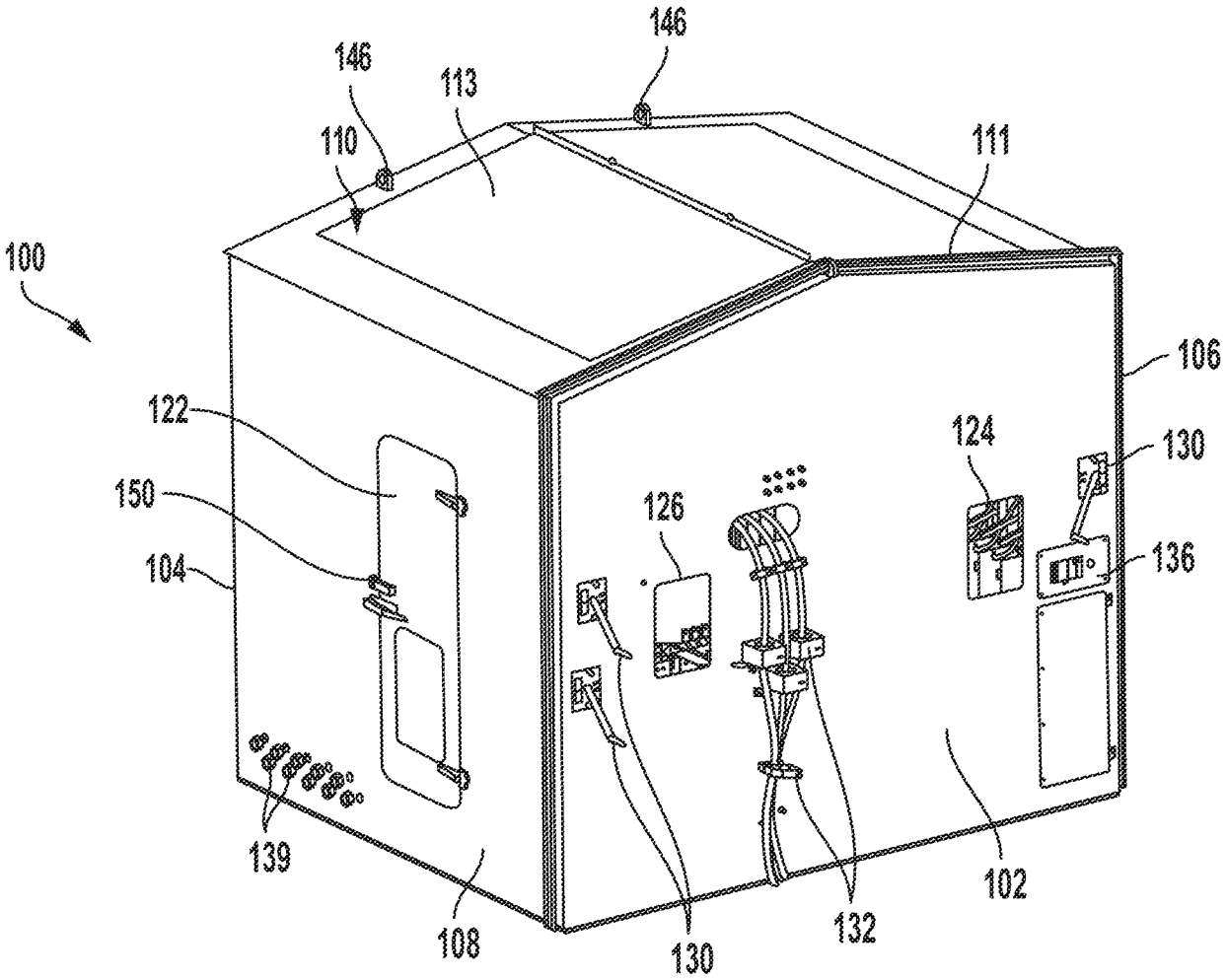
FIG. 4 is a front perspective view of the medium voltage room of FIG. 1.
Figure 5:
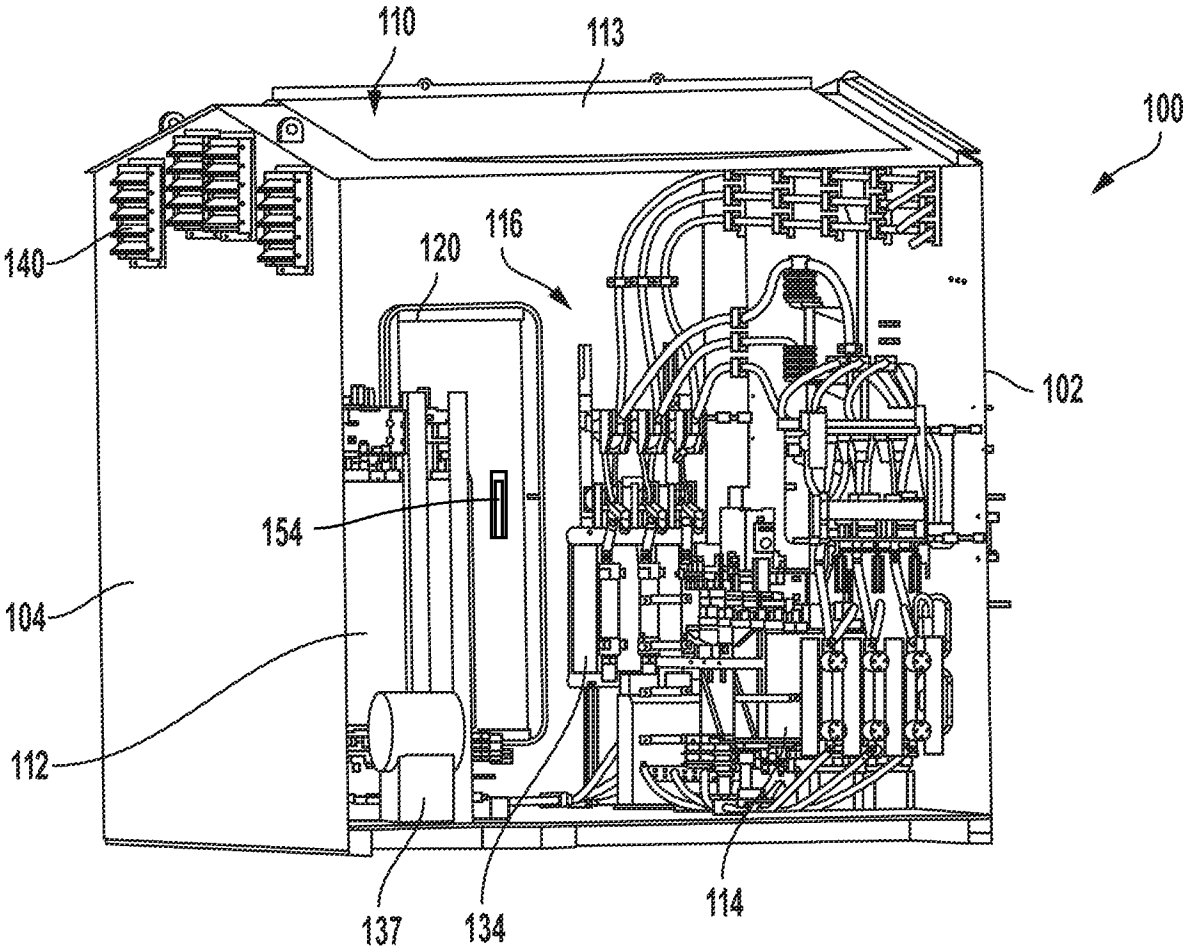
FIG. 5 is a right perspective view of the medium voltage room of FIG. 1, with a right wall of the room hidden.
Figure 6:
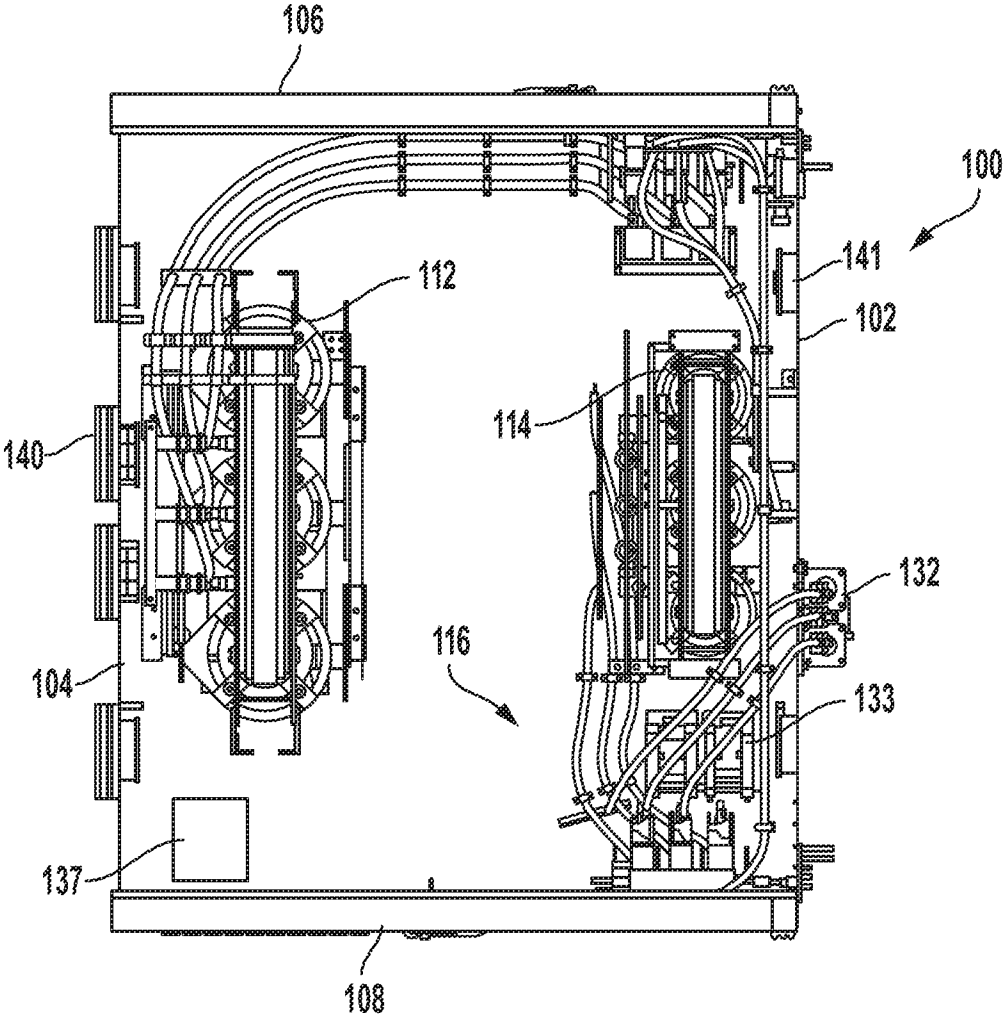
FIG. 6 is a top view of the medium voltage room of FIG. 1, with a roof of the room hidden.

Referring to FIGS. 4-6, the illustrated MV room 100 includes a front wall 102, a rear wall 104, a left side wall 106, a right side wall 108, and a roof 110. The walls 102, 104, 106, 108, and roof 110 are interconnected such that the MV room 100 is fully enclosed and weathertight. In the illustrated embodiment, the MV room 100 has a rectangular footprint; however, the MV room 100 may be configured in other shapes in other embodiments. The front wall 102 is positioned adjacent the rear wall 56 of the main housing 38. A flexible connector 111 (FIG. 4) surrounds an interface between the front wall 102 of the MV room 100 and the rear wall 56 of the main housing 38, which inhibits the ingress of water and allows some relative movement between the MV room 100 and the main housing 38, advantageously reducing stresses on the MV room 100.

In the illustrated embodiment, the roof 110 includes a removable panel section 113 (FIG. 4) formed, for example, from sheet metal. A seal (not shown) may be provided between the removable panel section 113 and the surrounding portion of the roof 110 to provide a weathertight interface. The panel section 113 may be removed to facilitate installation, removal, and/or servicing of any of the components inside the MV room 110. In some embodiments, a common roof, such as the roof 40 (FIG. 1), may extend over both the main housing 38 and the MV room 100. This may provide additional protection for the MV room 100 from snow buildup in cold climates, for example.

Referring to FIG. 6, the illustrated MV room 100 encloses both a main transformer 112 and an auxiliary transformer 114 of the mining shovel 10. In other words, the main transformer 112 and the auxiliary transformer 114 are housed within the MV room 100. In other embodiments, the MV room 100 may house either the main transformer 112 or the auxiliary transformer 114, with the other of the main transformer 112 and the auxiliary transformer 114 being disposed outside the MV room 100.

The main transformer 112 may supply electric power to the hoist motors 74, 78, the swing motors 80, 82, and/or the propel motors for the tracks 34. The auxiliary transformer 114 may supply electric power to various systems and components of the mining shovel 10, such as the compressor 70, air filtration assembly 66, motor blowers, house heaters, welders, lights, controls, and the like.

The main transformer 112 is configured to convert a first high voltage input (e.g., between about 3000 Volts (V) and about 22,000 V at between about 1 Mega Volt-Amp (MVA) and about 4 MVA in some embodiments) to a relatively lower voltage output (e.g., between about 480 V and about 690 V in some embodiments) to be supplied to the motors 74, 78, 80, 82. The auxiliary transformer 114 is configured to convert a second high voltage input (e.g., between about 3000 V and about 22,000 V at between about 200 Kilo Volt-Amps (KVA) and about 500 KVA) to a relatively lower output voltage (e.g., about 460 V, 415 V, 380 V, 240 V, 220 V, 208 V, or less, or between about 120 V and about 460 V) for use on multiple secondary applications. The high voltage inputs and the lower voltage outputs are AC voltages in the illustrated embodiment, with a frequency of 50 hertz in some embodiments, or 60 hertz in other embodiments. In some embodiments, the first high voltage input and the second high voltage input may be the same.

Figure 3:
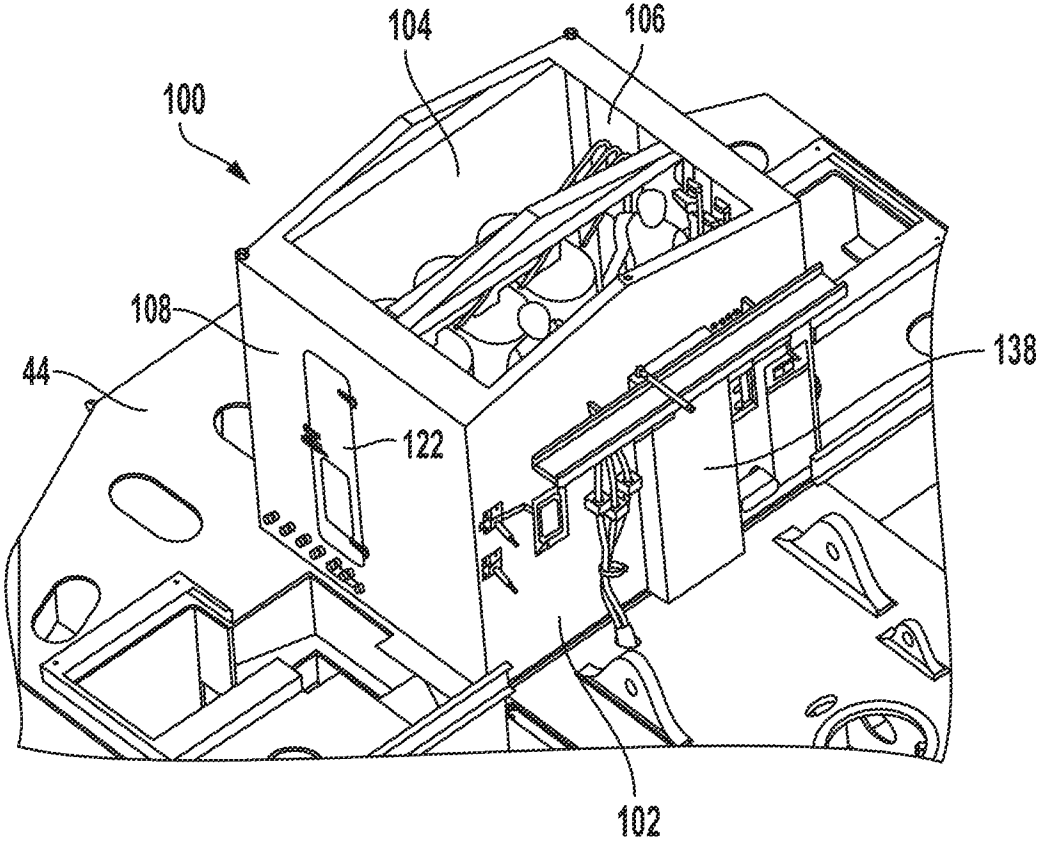
FIG. 3 is a perspective view of a portion of the mining shovel of FIG. 1 including the medium voltage room.
Figure 7:
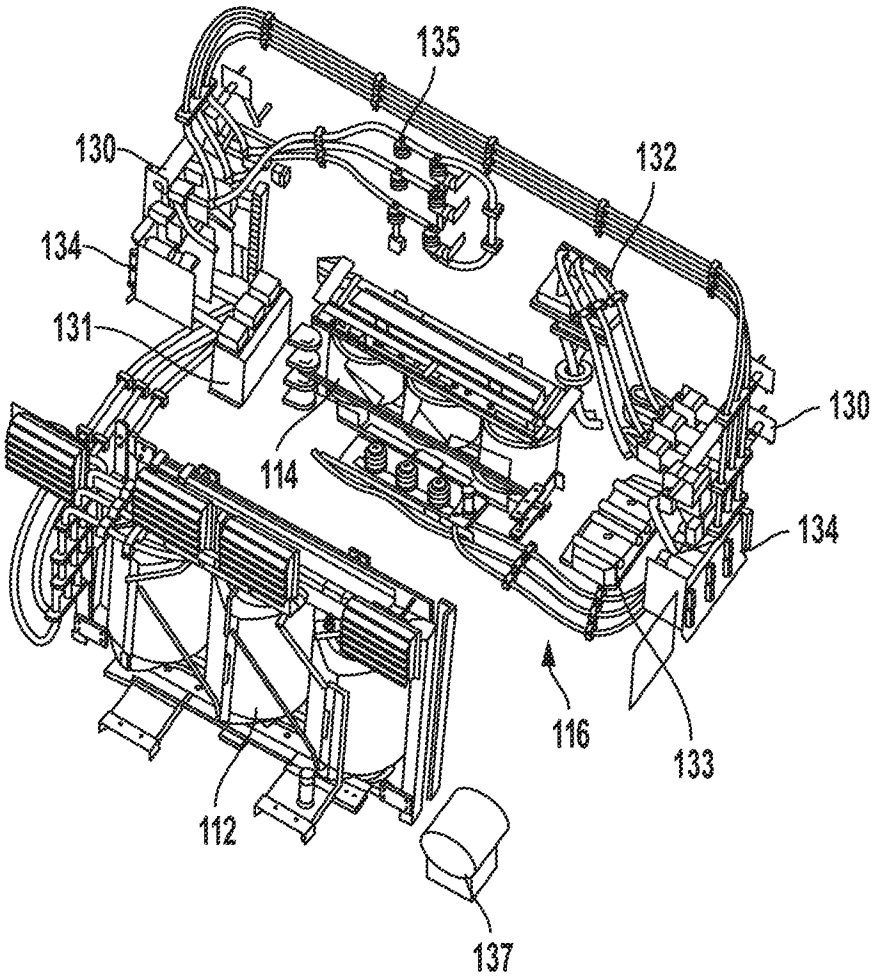
FIG. 7 is a perspective view illustrating electrical equipment contained within the medium voltage room of FIG. 1.

With reference to FIG. 7, the MV room 100 also encloses various other electrical components 116, such as loadbreak switches 130 (e.g., VERSARUPTER switches) for the main and auxiliary transformers 112, 114, vacuum contactors 131 for the main transformer 112, current transformers 132, potential transformers 133, fuses 134, lightning arrestors 135, power monitoring hardware 136 (FIG. 4), arc flash sensors, and anti-condensation heaters 137. Panelboards and breaker panels 138 for 208-460 V components may also be housed within or attached to the MV room 100 (FIG. 3).

Referring to FIG. 4, in the illustrated embodiment, a plurality of connectors 139 is provided in the right wall 108 of the MV room 100. The illustrated connectors 139 are strain relief and grounding connectors for power input cables of the shovel 10, such as variable frequency drive cables for the motors 74, 78. The connectors 139 facilitate passage of the power input cables from the external environment into the enclosed MV room 100. In other embodiments, the connectors 139 may be positioned in other locations of the MV room 100.

Because the medium voltage components are consolidated, the MV room 100 can advantageously be preassembled as a module in a factory environment. The illustrated MV room 100 includes lifting brackets 146 or other lifting provisions to facilitate moving the MV room 100 as a unit into position on the main body 14 of the shovel 10 during assembly (e.g., using a crane or hoist). In addition, the MV room 100 advantageously simplifies wiring (e.g., external bus bars and wiring between cabinets can be eliminated), and wiring in the field during assembly of the shovel 10 is minimized. This results in substantial time and cost savings. In addition, the MV room 100 is relatively compact, allowing the size of the main housing 38 to be reduced. For example, the main housing 38 of the shovel 10 may be at least twenty percent smaller than that of a typical comparable electric shovel. In some embodiments, the main housing 38 of the shovel 10 may be at least thirty percent smaller than that of a typical comparable electric shovel. This too results in substantial cost savings.

The illustrated MV room 100 has two access doors 120, 122 (FIGS. 3-4) that are configured to permit and operator to enter the MV room 100 to service the electrical components inside the MV room 100. Each of the access doors 120, 122 preferably includes a weathertight seal. The access doors 120, 122 are interlocked (e.g., by a trapped key interlock 150 such as a KIRK key system) to prevent entry into the MV room 100 while the transformers 112, 114 and other medium voltage electrical components are energized.

For example, in some embodiments, an interlock key may be provided in a substation that supplies the high voltage power to the shovel 10. The key is retrievable only when the high voltage power to the shovel 10 is shut off at the substation. An operator can then bring the key to the MV room 100 and insert it into the interlock 150 on one of the access doors 120, 122 to permit entry through the access doors 120, 122.

In some embodiments, an emergency escape override 154 may be provided on the inner side of one or both of the access doors 120, 122 (FIG. 5). The override 154 allows the associated access door 120, 122 to be opened from the inside the MV room 100, even if the interlock 150 is locked. Viewing windows 124, 126 (FIG. 4) are also provided to enable an operator to observe the electrical components inside the MV room 100 without entering (e.g., for visual confirmation of the position of the loadbreak switches 130).

Referring to FIGS. 5 and 6, the MV room 100 may include both exhaust and intake fans 140, 141 to bring clean filtered air into the room 100 and to exhaust the warmest air from the room 100 near the roof 110. These fans 140, 141 may be thermostatically controlled through a thermostat or controlled by the shovel controller with input from a temperature detector in the room. The exhaust fans 140 in the illustrated embodiment are louvered and screened to inhibit entry of dust, insects, and the like when the fans 140 are not operating. The intake fans 141 may include one or more filters, screens, and the like, or may be coupled to a filtered source of air (e.g., via ducting).

Thus, the disclosure provides, in one aspect, a mining shovel that includes a main transformer 112, an auxiliary transformer 114, and medium voltage switchgear all located in a combined MV room 100. By consolidating all medium voltage components into one room, the MV room 100 can thus be preassembled as a module. Wiring is simplified (e.g., external bus bars and wiring between cabinets can be eliminated), deck space is opened up, and the need for individual housings over the MV components is eliminated. The combined MV room 100 can also offer consolidation of duplicate components such as cabinet heaters, thermostats and arc flash sensors.

The MV room 100 may further provide improved safety because all components are contained within a room that has controlled access through KIRK key interlock, compared with bolt-on panels. Because all wiring inside of the MV room 100 may be isolated with a KIRK key type lock that assures the room has no power when entering, the safety of the room is improved over current transformer cabinets, which could simply be unbolted for access.

In addition, because access to the MV room 100 is controlled, the transformers 112, 114 and the other medium voltage components positioned inside the MV room 100 can be connected with unguarded electrical connections. That is, the electrical connections are not encased in insulators, enclosed in separate cabinets, or the like. As such servicing and maintaining the medium voltage components is simplified.

The consolidated MV room 100 may also be thermostatically controlled with the use of a heater 137, exhaust fans 140 and intake fans 141, which maintain appropriate room and component temperatures. The MV room 100 may have a removable roof panel 113 which can allow easy access to replace major items such as the main or auxiliary transformer 112, 114 without disrupting any components inside the main housing 38.

The MV room 100 may also allow direct integration of disconnect and power distribution for 208-460V breaker panels or panelboards 138 by directly attaching them to the front wall 102 of the room 100. This eliminates additional fuses or breakers due to the immediate proximity of the panelboards 138 to the auxiliary transformer 114. The panelboards 138 may also be pre-wired in the factory directly to the auxiliary transformer 114, eliminating some field wiring.

Another benefit of the disclosed MV room 100 is removing some electrical components from inside the main housing 38 to outside the main housing 38. This reduces the temperature inside the main housing 38, thereby increasing the reliability of all equipment operating in the main housing 38, particularly in hot climates. The main housing 38 may also be made significantly shorter, since it does not need to accommodate the MV components.

Although the disclosure has been described in detail with reference to certain preferred embodiments, variations and modifications exist within the scope and spirit of one or more independent aspects of the disclosure as described.

Various features of the disclosure are set forth in the following claims.

What is claimed is:

1. A mobile mining machine comprising:
a base including a deck and a counterweight box;
a hoist drum supported on the deck;
a motor drivably coupled to the hoist drum;
a main transformer configured to supply power to the motor;
an auxiliary transformer; and
an electrical room coupled to the base,
wherein the main transformer and the auxiliary transformer are positioned inside the electrical room, and
wherein the electrical room contains at least one unguarded electrical connection.

2. The mobile mining machine of claim 1, wherein the electrical room is located on the counterweight box.

3. The mobile mining machine of claim 1, further comprising a main housing supported on the deck, the main housing enclosing the hoist drum and the motor, wherein the electrical room is located outside of the main housing.

4. The mobile mining machine of claim 1, further comprising a loadbreak switch associated with the main transformer, wherein the loadbreak switch is positioned inside the electrical room.

5. The mobile mining machine of claim 1, wherein the main transformer is configured to convert an input voltage of between 3,000 V and 22,000 V to an output voltage of between 480 V and 690 V.

6. The mobile mining machine of claim 5, wherein the auxiliary transformer is configured to convert an input voltage of between about 3,000 V and 22,000 V to an output voltage of between 120 V and 460 V.

7. The mobile mining machine of claim 1, further comprising an air filtration assembly, wherein the auxiliary transformer is configured to supply power to the air filtration assembly.

8. The mobile mining machine of claim 1, wherein the electrical room includes an access door configured to permit an operator to enter the electrical room and an interlock device coupled to the access door, wherein the interlock device is configured to prevent the access door from being opened when the main transformer or the auxiliary transformer is energized.

9. A mobile mining machine comprising:
a base including a deck and a counterweight box;
a main housing coupled to the deck;

an electrical room including
a plurality of walls,
a roof, and
an access door configured to permit an operator to enter the electrical room;
a transformer positioned inside the electrical room; and
a loadbreak switch associated with the transformer and positioned inside the electrical room.

10. The mobile mining machine of claim 9, wherein the electrical room is positioned on the counterweight box outside of the main housing.

11. The mobile mining machine of claim 10, wherein the main housing includes a rear wall, wherein the plurality of walls of the electrical room includes a front wall positioned adjacent the rear wall of the main housing, and wherein the electrical room further includes a flexible connector surrounding an interface between the front wall and the rear wall.

12. The mobile mining machine of claim 9, wherein the electrical room includes a lifting bracket.

13. The mobile mining machine of claim 9, wherein the roof includes a removable panel section.

14. The mobile mining machine of claim 9, wherein the electrical room includes an interlock device coupled to the access door, wherein the interlock device is configured to prevent the access door from being opened from outside the electrical room when the transformer is energized.

15. The mobile mining machine of claim 14, wherein the electrical room includes an override configured to permit the access door to be opened from inside the electrical room.

16. An electrical room for a mobile mining machine, the electrical room comprising:
a plurality of side walls;
a roof interconnected with the plurality of side walls;
a main transformer disposed within the electrical room and configured to supply power to a first plurality of external loads;
an auxiliary transformer disposed within the electrical room and configured to supply power to a second plurality of external loads; and
a plurality of loadbreak switches disposed within the electrical room,
wherein the electrical room contains a plurality of unguarded electrical connections.

17. The electrical room of claim 16, wherein the roof includes a removable panel section.

18. The electrical room of claim 16, further comprising an exhaust fan configured to exhaust warm air from the electrical room.

19. The electrical room of claim 16, further comprising an access door configured to permit an operator to enter the electrical room.

20. The electrical room of claim 19, further comprising an interlock device coupled to the access door, wherein the interlock device is configured to prevent the access door from being opened from outside the electrical room when the main transformer or the auxiliary transformer is energized.

* * * * *